US007021573B2

(12) United States Patent
Savin

(10) Patent No.: US 7,021,573 B2
(45) Date of Patent: Apr. 4, 2006

(54) PROCESS FOR DRY MILLING ZINC POWDER TO PRODUCE ZINC FLAKE

(76) Inventor: Ronald R. Savin, 11001 Muirfield Dr., Rancho Mirage, Palm Springs, CA (US) 92270

( * ) Notice: Subject to any disclaimer, the term of this patent is extended or adjusted under 35 U.S.C. 154(b) by 150 days.

(21) Appl. No.: 10/666,740

(22) Filed: Sep. 19, 2003

(65) Prior Publication Data

US 2005/0150984 A1 Jul. 14, 2005

Related U.S. Application Data

(60) Provisional application No. 60/413,000, filed on Sep. 23, 2002, provisional application No. 60/438,338, filed on Jan. 7, 2003.

(51) Int. Cl.
*B02C 19/12* (2006.01)

(52) U.S. Cl. ..... 241/22; 241/23

(58) Field of Classification Search ..... 523/205; 106/403, 404; 241/21, 22, 16, 23, 65
See application file for complete search history.

(56) References Cited

U.S. PATENT DOCUMENTS 3,172,546 A * 3/1965 Schreiner ..... 241/23
3,389,105 A 6/1968 Bolger
4,129,443 A * 12/1978 Kaufman ..... 419/32

* cited by examiner

*Primary Examiner*—Mark Rosenbaum
(74) *Attorney, Agent, or Firm*—Ladas and Parry LLP

(57) ABSTRACT

A method for the production of zinc flake from zinc particles by dry milling the zinc particles using a mixture of a fluorocarbon lubricant and a stearate lubricant, optionally in admixture with a hydrophobic inorganic powder.

10 Claims, No Drawings

PROCESS FOR DRY MILLING ZINC POWDER TO PRODUCE ZINC FLAKE

The present invention relates to the production of zinc flake of use in compositions protection of metal structures from corrosion. It claims priority from application Ser. Nos. 60/413,000 filed on Sep. 23, 2002 and 60/438,338 filed on Jan. 7, 2003.

FIELD OF THE INVENTION

BACKGROUND OF THE INVENTION

Zinc particles are widely used in different types of coating compositions. Such particles exist in three forms: powder, dust and flake. The primary differences between the powder and dust on the one hand and flake on the other lie in their aspect ratio and their density. The aspect ratio of zinc flake (that is the ratio of diameter to thickness) is typically in the range of about 5:1 to 40:1, and preferably a range of about 15:1 to 25:1, more preferably about 20:1. Such flakes frequently have a thickness of from 0.5 to 2 microns, for example about 1 micron. Zinc powder on the other hand tends to spheroidal shaped particles having a particle size in the range 15 to 40 microns, whereas dust is also formed primarily of spheroidal particles of a size of from 3 to 15 microns. Zinc flake refers to particles having a particle size of 1 to 100 micros, preferably 6–50 microns, frequently in the range 10 to 15 microns as measured by a Coulter Particle Size Analyzer. Zinc dust has a tapped density above 3. Whereas zinc flake has a tapped density below 3, for example in the range 2 to 2.5, commonly about 2.4.

Because of its greater covering power and lower density than zinc dust, zinc flake has always appeared to be an attractive material to use.

U.S. Pat. No. 5,478,878 (Nagaoka, et al.) mentions the possible use of zinc flake in a polyphenylene ether/polyamide composition having improved resistance to discoloration upon exposure to light.

Zinc flake, has been suggested for use in a number of anti-corrosion compositions. For example U.S. Pat. No. 5,338,348 ("the '348 patent") discloses a coating composition for use in protecting metallic substrates from corrosion, comprising in weight percent, based on the total weight of the composition: from about 7% to 35% of film-forming substance; from about 35% to 55% of zinc powder (as defined above); from about 5% to 25% of zinc flakes; from about 1% to 5% at least one kind of amorphous silica; and up to about 30% particulate ferrophosphate.

U.S. Pat. No. 5,334,631 (Durand) describes a resin-based coating composition containing a mixture of zinc powder and zinc flake, it being taught that mineral spirits should be used with the flake to achieve a satisfactory composition.

Canadian Patent 2,074,329 relates to an improved powder coating composition comprising (a) a resin, (b) a curing agent and (c) zinc, wherein the zinc is a mixture of (c1) lamellar zinc (zinc flakes) and (c2) zinc dust.

A similar suggestion to use a combination of powder and flake is found in by Libuse Hochmannova in European Paint Journal, August 2002.

Despite the apparent desirability of using zinc flake rather than zinc dust, however, it has always been a problem to produce zinc flake at a price which is acceptable for broad-based use. For this reason, use of zinc flake has been largely confined to the coating of small parts in the fastener industry where cost is not a major consideration.

Typically metal flake particles are made by milling, for example ball milling, Such milling typically takes place in the presence of a lubricant. In principle two approaches are used either a wet method, in which stearic acid and mineral spirit are present or a dry method. The wet method is the principle method used for commercial production. However, the wet method is inherently expensive because flaking does not proceed rapidly, the materials of construction of the equipment used must be chosen to avoid contamination and the mineral spirits used are themselves flammable resulting in the need to take precautions to minimize the risk of fire. Furthermore a major problem in production of zinc flake has been removal of the solvent when a wet method is used since the presence of mineral spirits is not normally compatible with formulating the flake with conventional coating components such as epoxy resin or water-borne silicate-based compositions. Dry methods have, however, found only limited commercial acceptance.

U.S. Pat. No. 2,432,465 (Babcock) describes a method in which it is stated zinc or lead flake may be produced by a dry method. This is effected by disintegration of metal foil of a thickness of about 0.00065 inch in a stamp or hammer mill. Small pieces of aluminum foil may be used as lubricant, optionally in conjunction with an oily, greasy or fatty material.

U.S. Pat. No. 3,389,105 (Bolger) describes the production of metal flake from metal powder in a ball mil or stamping mill using a fluorocarbon resin as a grinding agent, optionally in combination with a material such as stearic acid. The milling technique may be wet or dry. The method is taught to be of particular use for production of "gold-bronze" flake but can be used for other metals.

U.S. Pat. No. 3,941,584 (Tindermann et al.) teaches ball milling of metal particles to produce flake. The teaching focuses on the production of aluminum flake but also describes production of zinc flake in a ball mill using a mixture of mineral spirits and stearic acid as a lubricant.

U.S. Pat. No. 4,318,747 (Ishijima) describes the production of flake pigments for use in a coting composition. Such flake particles are produced by, for example, wet ball milling using mineral spirits.

U.S. Pat. No. 4,469,282 (Booz) describes production of metal flake, particularly aluminum flake, by milling in the presence of a lubricant and a solvent. Long chain fatty acids such as stearic acid are suggested as possible lubricants and mineral spirits as solvent.

U.S. Pat. No. 4,820,552 (Espinosa et al.) teaches the production of metal flakes, such as zinc flakes by grinding metal particles in a hydrocarbon liquid in the presence of a surfactant and a metal oxide.

My U.S. Pat. No. 5,677,367 describes a soluble graphite containing zinc-rich composition so as to decouple manufacture of the dry composition from use of the solvent.

SUMMARY OF THE INVENTION

Two major problems have existed with dry milling of zinc powder. One is that in view of the heat generated, the particle tend to sinter together. The other is that because of the low ignition temperature of zinc dust, there is a significant risk of fire.

I have now found that the sintering and ignition problems which have hitherto prevented the use of dry milling techniques for production of zinc flake can be overcome if the milling is carried out with continuous cooling and using a mixture of a stearate (preferably lithium stearate) and a fluorocarbon polymer (preferably ploytetrafluoro ethylene)

as the lubricant and silica powder (preferably fumed silica) in the mill to assist in separation of the zinc particles during milling.

Accordingly, the present invention provides a method for the production of zinc flake from zinc particles which comprises dry milling said zinc particles using a mixture of a fluorocarbon lubricant and a stearate lubricant, optionally in admixture with a hydrophobic inorganic powder.

DETAILED DESCRIPTION OF THE INVENTION

According to the present invention, zinc particles, of a size of from 1 to 40 microns, more commonly 2 to 40 microns, typically a powder of a size 15 to 40 microns, preferably about 20 microns or a dust of a size 3 to 15 microns and preferably of a size 4-6 microns are milled to produce zinc flake. Such particles are commercially available, for example from Zinc Corp. of America, Purity Zinc or Unicor. The zinc particles used may be in the form of relatively pure zinc or an alloy, for example with nickel. Such alloys may contain up to 30% by weight of nickel Alternatively a mixture of zinc and nickel particles may be used in which nickel replaces up to 30%, for example 10 to 30%, by weight of the zinc. The presence of nickel either as an alloy or in admixture may improve the corrosion resistant properties of compositions incorporating flake produced by the present invention.

Milling may be carried out in any convenient manner in which the mill may be continuously or continually cooled during the milling operation. For example cooling water may be passed through a cooling jacket surrounding the mill. Such water will normally be introduced at a temperature of 10 to 20° C. (50 to 70° F.). Lower temperatures may, however be desirable, particularly with large mills. If desired the cooling water may be recycled, for example through a heat exchanger or a refrigeration system to cool it. If such recycling using a heat exchanger or refrigeration is used, it may be desirable to include an antifreeze agent in the water, for example ethylene glycol, to permit the use of lower temperatures, for example down to −16° C. (0° F.) or lower, than would otherwise be possible.

Typically milling is carried out in a ball or pebble mill using balls (normally made of stainless steel) of 5 to 15 mm diameter. I have found that ball milling in which the mill is loaded with balls in an amount of from 50 to 60% of the mill's internal volume is particularly useful. Such milling operates at a shear rate of 40 to 100 r.p.m, preferably 40 to 60 r.p.m. Zinc dust may be used in a amount that typically occupies another 5 to 25% of the interior volume of the mill.

The primary lubricant for use is a fluorocarbon polymer, preferably poly tetrafluoroethylene. However, other solid fluorocarbon polymers such as copolymers of tetrafluoroethylene may be used such as copolymers of tetrafluoroethylene and up to about 25 weight percent of hexafluoropropylene or copolymers of tetrafluoroethylene and up to about 15 weight percent of perfluoropropylvinyl ether. The primary lubricant should be used in an amount of from is present in an amount of from 1 to 5 weight percent based on the weight of zinc. Typically the amount will be in the range 1.5 to 3%, often about 2% based on the weight of zinc. Use of such fluorocarbon resin substantially reduces problems with generation of aerial dust which ca cause respiratory problems.

The stearate to be used as co-lubricant is used in an amount less than the fluorocarbon lubricant. Typically the amount of stearate lubricant is from about one third to two thirds of the amount of fluorocarbon, for example about half of the weight of the fluorocarbon. The preferred stearate is lithium stearate. However in some cases, other stearates may be of use. Particularly preferred are stearates which are stable to relatively high temperatures having properties similar to lithium stearate which is stable up to 550° F. (290° C.). It may also be useful to include stearic acid with the stearates.

It is normally desirable for a small amount of hydrophobic powder also to be present during the milling to reduce penetration of moisture into the flake and also to reduce the milling time. I have found hydrophobic fumed silica to be particularly suitable for this purpose. The amount of such material to be used is typically from 10 to 50% by weight of the fluorocarbon lubricant, typically about 25% of the weight of the primary lubricant.

I have found that use of from 1.5 to 3% (for example 2%) by weight of PTFE, 0.5 to 1.5% (for example 1%) lithium stearate and from 0.2 to 0.8% by weight (for example 0.5%) of hydrophobic fumed silica based on the weight of zinc powder being treated is particularly useful In some cases, other lubricants may also be employed, for example graphite powder may also be present. When present, the graphite particles are typically present in an amount of from 1 to 5 weight percent, preferably 2 to 3 weight percent based on the weight of the zinc. Similarly the incorporation of from 2 to 4% by weight of mica may be advantageous in reducing the milling time required.

The present invention is illustrated by the following Example.

EXAMPLE

Several samples of product were prepared in the following manner.

The apparatus used was a pebble mill loaded to 55% of it volume with 0.625 mm diameter stainless steel balls The mill was fitted with a cooling jacket through which cooling water was passed during the milling.

The mill was loaded with 100 parts of #64 zinc dust (having a density of 3 and an average particle size of 4 to 6 microns)supplied by Umicore., 2 parts of PTFE supplied by DuPont, 1 part of lithium stearate supplied by Witco and 0.5 parts of R 972 Aerosil (a hydrophobic fumed silica) supplied by Degussa.

The mixture was milled for 10 to 12 hours to produce a bright zinc flake having an apparent density of between 2.2 and 2.5 microns and an average particle size of 10 to 15 microns and thickness of from 1 to 2 microns.

The products were found to be resistant to corrosion when tested in accordance with ASTM, B-119 salt fog where no red rust was observed after 1000 hours of exposure. No sintering of flakes was observed in the products.

In order to determine the stability of the products obtained, I subjected 10 gram samples of the flake produced to heating at 500° F. for 15 minutes. All samples produced in which continuous cooling had been effected during milling were stable and showed no weight gain. Comparative samples which had been produced in a similar manner but without continuous cooling during milling became oxidized during manufacture, often leading to ignition during testing and a weight increase of 10 to 20% due to the oxidation.

The invention claimed is:

1. A method for the production of zinc flake from zinc particles which comprises dry milling said zinc particles in the presence of a lubricant and optionally in admixture with a hydrophobic inorganic powder, wherein the mill is continuously cooled by passing cooling water to contact the mill.

2. A method as claimed in claim 1 wherein the zinc particles have a particle size of from 1 to 40 microns.

3. A method as claimed in claim 1 wherein the zinc particles are in the form of zinc dust and have a particle size of from 1 to 15 microns.

4. A method as claimed in claim 3 wherein said dust has a particle size of 4 to 6 microns.

5. A method as claimed in 1 wherein the lubricant is PTFE.

6. A method as claimed in claim 1 wherein the lubricant is present in an amount of from 1 to 5 weight percent based on the weight of zinc.

7. A method as claimed in claim 1 wherein said hydrophobic inorganic powder is hydrophobic fumed silica.

8. A method as claimed in claim 7 wherein said hydrophobic inorganic particles are present in an amount of from 0.1 to 0.5 based on the amount of lubricant.

9. A method as claimed in claim 1 wherein said zinc particles are milled for a sufficient period to produce flakes having an average diameter of from 10 to 15 microns and a thickness of from 1 to 2 microns.

10. A method as claimed in claim 1 wherein the zinc is mixed or alloyed with nickel.

* * * * *